United States Patent [19]

Haacke

[11] 3,998,752

[45] Dec. 21, 1976

[54] INFRARED REFLECTIVE COATING FOR VISIBLE LIGHT TRANSMITTING SUBSTRATES

[75] Inventor: Gottfried Haacke, Stamford, Conn.

[73] Assignee: American Cyanamid Company, Stamford, Conn.

[22] Filed: Feb. 27, 1976

[21] Appl. No.: 661,885

[52] U.S. Cl. ..... 252/300; 423/593; 423/618

[51] Int. Cl.[2] ..... F21V 9/04

[58] Field of Search ..... 252/300, 518 R, 62.3 BT, 252/62.3 R; 423/593, 618

[56] References Cited

UNITED STATES PATENTS

| | | | |
|---|---|---|---|
| 3,773,914 | 11/1973 | Nozik | 423/593 |
| 3,811,953 | 5/1974 | Nozik | 423/593 |
| 3,815,036 | 6/1974 | Nozik | 350/1 |
| 3,876,552 | 4/1975 | Moynihan | 252/300 |

OTHER PUBLICATIONS

Nozik, A. J., "Optical and Electrical Properties of $CdSnO_4$: A Defect Semiconductor", Physical Review B, vol. 6, No. 2 (7-15-72) pp. 453-459.

Coffeen, W. W., "Ceramic and Dielectric Properties of the Stannates", J. Amer. Ceram. Soc., vol. 36, No. 7 (7-1-53) pp. 207-214.

Hassanein, M. "Solid-State Reaction in the System Cadmium-Magnesium-Tin Oxides" J. Chem. UAR, 9, No. 3 (1966) pp. 275-280.

*Primary Examiner*—Benjamin R. Padgett
*Assistant Examiner*—Deborah L. Kyle
*Attorney, Agent, or Firm*—John L. Sullivan

[57] ABSTRACT

The infrared reflectivity of cadmium stannate ($Cd_2SnO_4$) films between 0.6 and 1.5 microns wavelength can be increased by doping the films with copper whereby the films can be used as architectural window coatings.

3 Claims, No Drawings

INFRARED REFLECTIVE COATING FOR VISIBLE LIGHT TRANSMITTING SUBSTRATES

This invention relates to architectural window coatings. More particularly, it relates to window coatings which transmit visible light but reflect the infrared portion of the incoming sunlight. Still more particularly, it relates to a method for increasing the infrared reflectivity of cadmium stannate films by doping these films with small amounts of copper whereby they are made highly useful as architectural window coatings.

Increasing cost and scarcity of energy has led to a growing emphasis on energy conservation. Among the various sectors of energy consumption, heating and cooling of buildings accounts for twenty-five percent of the total United States energy requirements so that efficient conservation measures in this field could have a significant impact on the national energy balance.

Modern architectural design stresses the use of large glass areas which contribute to the esthetic appearance of a building, but also to high energy consumption. Large glass surfaces in buildings account for large heat losses during the winter season and for excessive heating by direct solar radiation in summer. The latter effect is a major contribution to energy cost since it costs three to six times more to cool a building one degree than to heat it by the same amount.

One approach towards reducing the air conditioning requirements of buildings utilizes the infrared reflective properties of thin metallic films of metals, such as gold. These films transmit visible light, if sufficiently thin, and reflect the infrared portion of the incoming sunlight. Since approximately fifty percent of the solar insolation is infrared radiation, its exclusion from buildings results in a substantial reduction of the total heat load during the summer season.

Heat reflective gold coatings on architectural glazing have two peripheral disadvantages. First of all, thin gold films, even when transmitting visible light, are highly reflective not only to infrared radiation, but also to visible sunlight. This property results in a metallic glare which is objectionable to most observers. In addition, gold is expensive even though it is used as only a thin film. The cost disadvantage of a gold coating can be overcome by replacing it with non-noble metal films. However, such films still exhibit metallic glare and often have stability problems which require the deposition of additional layers for protection against oxidation.

An alternative to heat reflective metal layers is presented by certain semiconductor films. If the energy gap of these materials is large enough (~3 eV) they are transparent to visible light. Furthermore, in some large-band gap semiconductors the free electron concentration can considerably exceed $10^{20}$ per cubic centimeter thus inducing a high infrared reflectivity.

Infrared reflectivity caused by free electrons in a semiconductor, in general, does not become noticeable below 1.5 micron wavelength. Hence, the heat reflective properties of these materials can only be utilized for thermal radiation having wavelengths longer than 1.5 micron. In contrast, solar thermal radiation occurs mainly in the 0.7 to 1.5 micron range. A heat reflective semiconductor coating, therefore, is not suitable per se for architectural glass application. In fact, it would act as a greenhouse window coating. Thus, in that case, the total solar radiation, visible and infrared, is transmitted into the building where it is converted to longer wavelength heat radiation which cannot escape back through the coated windows since they reflect long-wavelength infrared light.

One of the most outstanding transparent, heat reflecting semiconductors is cadmium stannate ($Cd_2SnO_4$). It combines high visible transparency with high infrared reflectivity if its free electron concentration is brought to approximately $10^{21}cm^{-3}$ by creating oxygen vacancies and interstitial cadmium (U.S. Pat. No. 3,811,953). In this condition, cadmium stannate films start reflecting infrared light at approximately 1.5 micron, reach 80% reflectivity at 2 micron and 90% at 6 micron. These properties make cadmium stannate films highly suitable for greenhouse window applications.

It has now been found that doping of cadmium stannate with copper increases the infrared reflectivity between 0.6 micron and 1.5 micron wavelength so that films made out of this material can be utilized for architectural window coatings.

The following examples illustrate the invention.

EXAMPLE 1

The following materials are mixed with mortar and pestel and ground until a uniform and homogeneous powder is obtained.

31.78 gm CdO
18.84 gm $SnO_2$
0.25 gm CuCl

The powder is transferred into an alumina crucible and fired for six hours at 1050°C. in air. After furnace cooling a tan colored ingot is obtained which has the nominal composition $Cd_{1.98}Cu_{.02}SnO_4$. X-ray analysis shows that this material is single phase and crystallized in the orthorhombic cadmium stannate structure.

A target plate is manufactured from the above material and installed in a radio frequency (RF) sputter system. After optimizing the RF tuning parameters a $Cd_{1.98}Cu_{.02}SnO_4$ film is deposited onto a transparent silica slide. The thickness of this film is 0.42 microns as determined from transmission interference fringes. Hemispherical angular reflectance measurements show that the reflectance at one micron wavelength increased to 43% from below 10% for cadmium stannate films which do not contain copper.

EXAMPLE 2

The target plate of Example 1 is used for the preparation of a second $Cd_{1.98}Cu_{.02}SnO_4$ film by RF sputtering. This film is 0.61 microns thick. Its hemispherical angular reflectance is 38% at one micron and 45% at 0.8 micron wavelength.

Both samples of Examples 1 and 2 have better than 85% optical transmission at a wavelength of 0.55 microns.

The amount of copper incorporated into the cadmium stannate for purpose of increasing its near infrared reflectivity should be sufficient to form the compound:

$$Cd_{2-x}Cu_xSnO_4$$

where $x$ is from 0.01 to about 0.3.

I claim:

1. A method for increasing the near infrared reflectivity of a $Cd_2SnO_4$ film comprising incorporating copper into the $Cd_2SnO_4$ in an amount to form $Cd_{2-x}Cu_xSnO_4$ where x is from 0.01 to about 0.3.

2. A window coating of high transmission to visible light and high reflectivity to infrared sunlight comprising copper-doped cadmium stannate of the formula:

$Cd_{2-x}Cu_xSnO_4$ where $x$ is from 0.01 to 0.3.

3. The window coating of claim 2 where the coating has the formula:

$Cd_{1.98}Cu_{0.02}SnO_4$

* * * * *